US007542377B2

(12) United States Patent
Kirschner et al.

(10) Patent No.: US 7,542,377 B2
(45) Date of Patent: Jun. 2, 2009

(54) INCREASED APERTURE HOMING CAVITATOR

(75) Inventors: Ivan N. Kirschner, Portsmouth, RI (US); Greg Buley, Bethesda, MD (US)

(73) Assignee: General Dynamics Information Technology, Inc., Fairfax, VA (US)

( * ) Notice: Subject to any disclaimer, the term of this patent is extended or adjusted under 35 U.S.C. 154(b) by 627 days.

(21) Appl. No.: 11/351,265

(22) Filed: Feb. 10, 2006

(65) Prior Publication Data

US 2007/0077044 A1 Apr. 5, 2007

Related U.S. Application Data

(60) Provisional application No. 60/651,624, filed on Feb. 11, 2005.

(51) Int. Cl.
*G01S 15/00* (2006.01)

(52) U.S. Cl. ..... 367/141

(58) Field of Classification Search ..... 367/141; 114/20.1, 20.2, 21.3, 61.12; 416/248; 440/44, 440/45

See application file for complete search history.

(56) References Cited

U.S. PATENT DOCUMENTS 7,453,769 B2 * 11/2008 Kirschner et al. ..... 367/99
2007/0077044 A1 * 4/2007 Kirschner et al. ..... 392/485
2008/0002526 A1 * 1/2008 Kirschner et al. ..... 367/87

OTHER PUBLICATIONS

Ihor Nesteruk, "The Problems of Drag Reduction in High Speed," The International Summer Scientific School, High Speed Hydrodynamics, Jun. 2002, Cheboksary, Russia.

Ihor Nesteruk, "Sub- and Supersonic Shapes Without Separation and Cavitation," exact date unknown, Kyiv, Ukraine, included as an Appendix to U.S. Appl. No. 60/651,624, filed Feb. 11, 2005.

Ihor Nesteruk, "Experimental Investigations of Concave Cavities, " exact date unknown, included as an Appendix to U.S. Appl. No. 60/651,624, filed Feb. 11, 2005.

* cited by examiner

*Primary Examiner*—Dan Pihulic
(74) *Attorney, Agent, or Firm*—Venable LLP; Ralph P. Albrecht

(57) ABSTRACT

Various exemplary embodiments of an increased aperture homing cavitator are disclosed. In one exemplary embodiment, a supercavitating body may include, e.g., but may not be limited to, a cavitator assembly having a front end and a back end, and having a shape operative to generate a concave cavity; an acoustical homing array coupled to the cavitator assembly; an afterbody coupled to the back end; a thruster coupled to the afterbody; and a ventilation system disposed within the afterbody, operative to supply gas to, and to maintain pressure within the cavity. In an exemplary embodiment, the size of the cavitator may be increased without a significant attendant increase in drag, thereby enabling a homing array of increased size and aperture.

16 Claims, 4 Drawing Sheets

INCREASED APERATURE HOMING CAVITATOR

INCREASED APERATURE HOMING CAVITATOR

INCREASED APERTURE HOMING CAVITATOR

RELATED APPLICATION

This application claims the benefit under 35 U.S.C. Section 119(e) of U.S. application No. 60/651,624, filed Feb. 11, 2005, entitled "Increased Aperture Homing Cavitator," to Kirschner et al., of common assignee, the contents of which are incorporated by reference in their entirety.

BACKGROUND OF THE INVENTION

1. Field of the Invention

The present invention relates generally to supercavitating high-speed bodies, and more particularly to supercavitating torpedoes.

2. Related Art

Homing supercavitating torpedo concepts currently being considered in ongoing research and development programs employ cavitators with a positive pressure drag coefficient, which is well known to produce a concave cavity that expands outward in the downstream direction from the cavity inception point to some maximum cavity radius, then contract to the point of cavity closure, usually positioned downstream of the body. A significant drag advantage is obtained via the near elimination of friction drag.

However, the small wetted area of the cavitator poses problems if that area is to host transducers suitable for forming the elements of a sonar system. Specifically, the amount of acoustical power that can be transmitted via the small wetted area is limited: overpowering the system causes cavitation on the nominally wetted transducer faces, causing severe performance degradation. Furthermore, the aperture of the sonar array is limited by the small cavitator diameter. Finally, the number of array elements that can be practically packed within such a small volume is also quite limited, which in turn limits the beam-forming capabilities of the system. Since drag of such a cavitator is directly proportional to its sectional area at the plane of cavity detachment, simply increasing the cavitator size is not a practical option, since it would eliminate the drag advantage that is otherwise gained via supercavitation.

What is needed then is an improved cavitator that overcomes shortcomings of conventional solutions.

SUMMARY OF THE INVENTION

In an exemplary embodiment of the present invention an increased aperture homing cavitator is disclosed.

In an exemplary embodiment, a supercavitating body may include, e.g., but may not be limited to, a cavitator assembly having a front end and a back end, and having a shape operative to generate a concave cavity; an acoustical homing array coupled to the cavitator assembly; an afterbody coupled to the back end; a thruster coupled to the afterbody; and a ventilation system disposed within the afterbody, operative to supply gas to, and to maintain pressure within the cavity.

In an exemplary embodiment, the size of the cavitator may be increased without a significant attendant increase in drag, thereby enabling a homing array of increased size and aperture.

Further features and advantages of the invention, as well as the structure and operation of various embodiments of the invention, are described in detail below with reference to the accompanying drawings.

BRIEF DESCRIPTION OF THE DRAWINGS

The foregoing and other features and advantages of the invention will be apparent from the following, more particular description of exemplary embodiments of the invention, as illustrated in the accompanying drawings wherein like reference numbers generally indicate identical, functionally similar, and/or structurally similar elements.

DETAILED DESCRIPTION OF EMBODIMENTS OF THE PRESENT INVENTION

Figure 1:
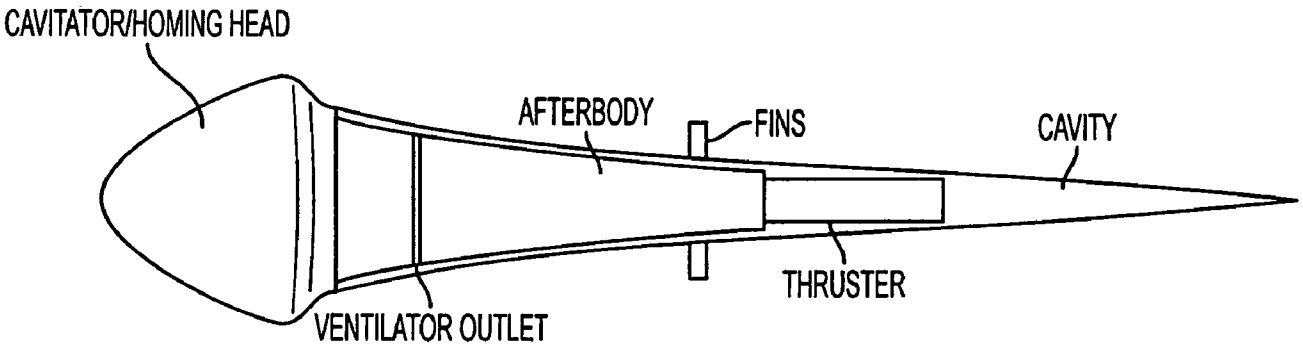
FIG. 1 depicts an external view of an exemplary embodiment of a supercavitating body according to the present invention.

An exemplary embodiment of the invention is discussed in detail below. While specific exemplary embodiments are discussed, it should be understood that this is done for illustration purposes only. A person skilled in the relevant art will recognize that other components and configurations can be used without parting from the spirit and scope of the invention.

An alternative cavitator design can generate a concave cavity that closes in a cusp. It is well known (see, for example, Batchelor, 1967; Lighthill, 1949; Nesteruk 2000-2004) that the cavitation number associated with a concave cavity is negative; that is, the cavity pressure is greater than ambient pressure. See for example, Nesteruk, I., (2002) "The Problems of Drag Reduction in High Speed Hydrodynamics," *Proceedings of the International Summer Scientific School on High-Speed Hydrodynamics* (*HSH*2002), National Academy of Sciences and Art of Chuvash Republic, Cheboksary, Russia, inter alia, the contents of which are incorporated herein by reference in their entireties. With the cavity closing in a cusp, it can also be shown that the total pressure drag on the cavitator-cavity system is identically zero. Under these conditions, the cavitator diameter can be increased without a pressure drag penalty. Thus, with the proper cavitator design, a large wetted area and cavitator volume will be available to host a sonar system, tending to eliminate the problems discussed above. Nesteruk has also shown that the friction drag associated with such a cavitator does not significantly degrade the drag advantage associated with supercavitation, provided the Reynolds number is sufficiently high, which is the case for the high-speed applications of interest.

Certain system constraints must be enforced to ensure that the cavity does not form at the point of minimum pressure near the location of maximum cavitator diameter. Specifically, the total pressure at that point must be greater than the vapor pressure of the surrounding liquid, which will in turn require that the operational depth of the system be greater than some speed-dependent value that can be easily determined for each specific cavitator design. At the same time, the cavity pressure must be maintained at a value greater than the ambient pressure, which will necessitate a cavity ventilation system, or ventilator. The cavitator design must also be selected to minimize flow separation downstream of the minimum pressure point, to maintain the drag advantage and to minimize homing system self noise. Self-noise will also be minimized if the cavitator profile is selected to maintain laminar flow over its forward part, at least through the location of maximum diameter.

An exemplary embodiment of the invention may be understood with the help of the figures. The body shown in FIGS. 1 and 2 travels from right to left. It is composed of a cavitator/homing head assembly, an afterbody, fins, a thruster (such as a rocket), and a ventilator, which includes an outlet system allowing high pressure gas to pass from the ventilator pressure or combustion chamber through the afterbody into the cavity.

The thruster produces a force to overcome the friction drag associated with the cavitator and any other drag components, such as the forces acting on the fins. The cavitator houses the sonar system. Various other components of the system that are not shown in these figures may include: a payload (such as a warhead); a guidance system (such as an inertial guidance system); a control system (such as an autopilot and homing control logic system); actuators for the fins; control wiring; gas ducting, plenums, et cetera for ventilation gas management; and structural systems to support each item and to support the various loads that will be endured during operation.

In all respects, the system behaves similarly to a torpedo: mobility is provided by the thruster; control is provided by the fins (or the alternatives listed below); sensing for detection, classification, localization, tracking, and targeting is provided by the homing cavitator; and the ultimate function of the system is performed by the payload.

The advantage of this system is the increased aperture and wetted area of the sonar system relative to that of currently considered supercavitating torpedo systems without a significant drag penalty. The new feature is the special homing cavitator shape selected to generated a concave cavity. The cavity-conforming afterbody shape may be selected to maximize the use of the cavity volume.

The advancement in the art taught by Nesteruk (2000-2004) is the addition of a sonar array to his hydrodynamical device, and the application of computational fluid dynamics models to produce evidence that a cavitator with such a shape can generate a stable cavity under conditions of a negative cavitation number; that is, when the pressure of the gas within the cavity is greater than that in the ambient liquid far upstream of, and at the same depth as, the cavitator. Accordingly, in an exemplary embodiment of the present invention, the cavitator assembly has a profile that is convex in the direction of travel and concave at its opposite end. The cavitator assembly forms a stable hydrodynamic cavitation region within which the cavity pressure of gas in the cavity is greater than the ambient hydrostatic pressure far upstream of and at the same depth as the cavitator assembly.

Figure 3:
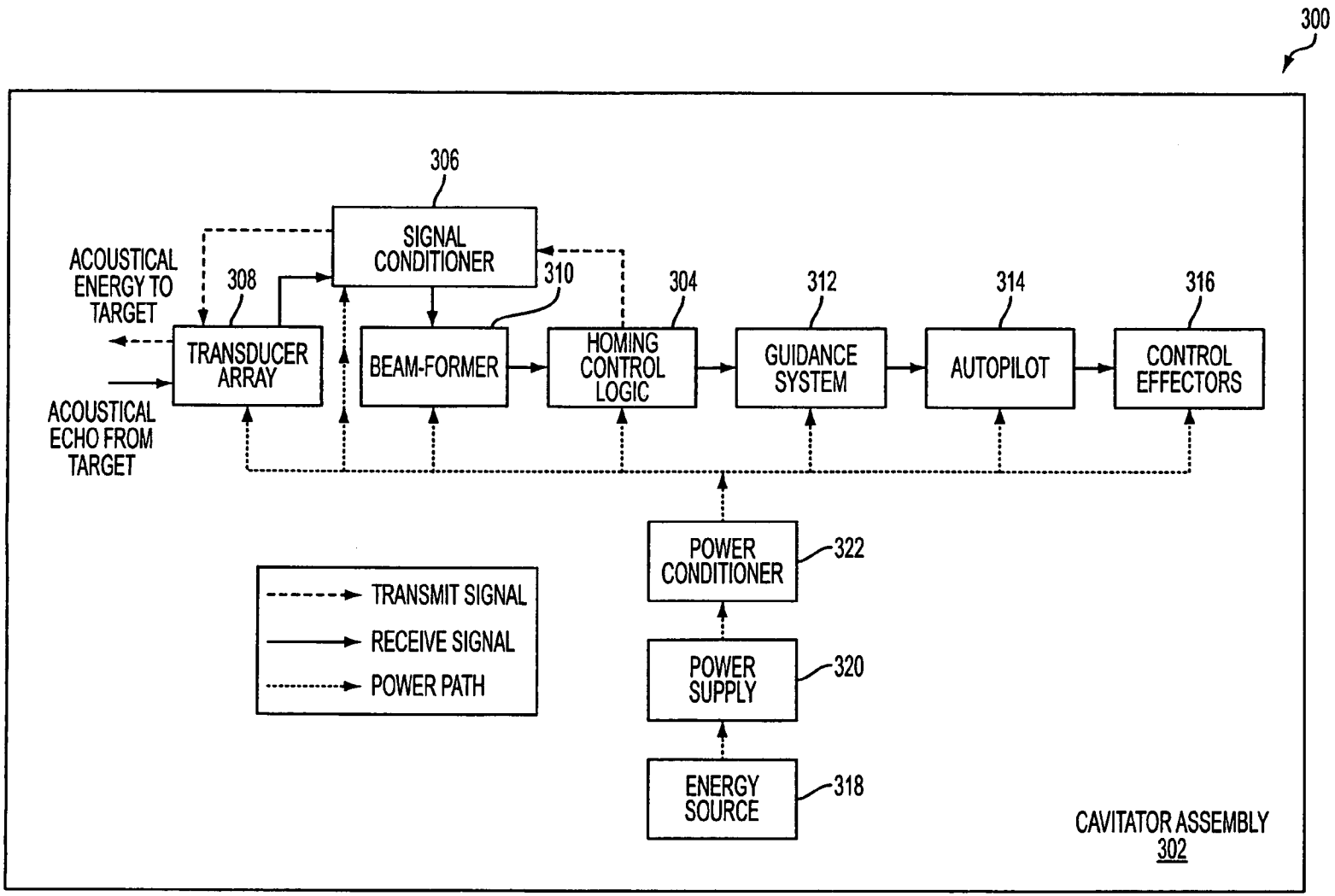
FIG. 3 depicts an exemplary embodiment of an exemplary block diagram of exemplary components disposed in a cavitator assembly according to exemplary embodiments of the present invention.

FIG. 3 depicts an exemplary embodiment of a block diagram 300 of one or more components that may be disposed inside or on the cavitator assembly. As illustrated in the exemplary embodiment of diagram 300, a cavitator assembly 302, in an exemplary embodiment, may include homing control logic 304 which may transmit a signal to a signal conditioner 306, which may in turn transmit a signal to a transducer array 308, which may itself in turn transmit acoustical energy toward a target as shown. As further illustrated in the exemplary embodiment of diagram 300, an acoustical echo may be received from the target at the transducer array 308, which may in turn transmit the received signal to the signal conditioner 306. As further illustrated in the exemplary embodiment of diagram 300, the signal conditioner 306 may further transmit the received signal to a beam-former 310, which may in turn transmit to the homing control logic 304, for further forwarding to a guidance system 312, in an exemplary embodiment. As further illustrated in the exemplary embodiment of diagram 300, the guidance system 312 may further transmit the received signal on to an auto-pilot 314, which may in turn transmit the received signal to control effectors 316, in an exemplary embodiment. As further illustrated, in the exemplary embodiment, an energy source 318 may provide power to a power supply 320. The power from supply 320 may be conditioned as shown with power conditioner 322 before being tendered to the various exemplary components 304-316 of exemplary cavitator assembly 302. The exemplary cavitator assembly 302 is provided by way of example only, not limitation. Furthermore, in alternative exemplary embodiments of this invention, it is anticipated that various components of the sonar, guidance, and control systems may be housed in the afterbody, rather than in the cavitator.

In an exemplary embodiment, the homing array in or on the cavitator may comprise one or more transducers, such as piezoelectric devices, or single-crystal elements, capable of transmitting to and receiving acoustical signals from the ambient liquid surrounding the body. In one embodiment, the homing array elements are located just beneath the surface of the cavitator, separated from the liquid by a waterproof and acoustically transparent layer designed to minimize turbulence in the adjoining flow of liquid over the cavitator face.

In another embodiment, the homing array elements are located such that their faces are coincident to a plane directed approximately perpendicular to the forward direction of the torpedo, and separated from the liquid by a waterproof and acoustically transparent cover designed to minimize turbulence in the adjoining flow of liquid over the cavitator face, and shaped to achieve a desired pressure distribution that is compatible with the desired hydrodynamical performance of the cavitator.

In yet a third embodiment, the homing array elements are distributed throughout the volume represented by a portion of the cavitator, and surrounded and covered by a waterproof and acoustically transparent material designed to fulfill functions similar to that described in the previous embodiment. In each embodiment, each transducer element is supported with respect to the cavitator in such fashion that, when activated, the resulting vibration of the transducer directs the acoustical energy into the water in an efficient fashion, without significant loss of energy to undesired motion or conversion and without significant degradation of signal. Also in each embodiment, the transducers and their support structure are arranged to accommodate electrical connections via which the activation signal is received and the return electrical signal is transmitted.

In an exemplary embodiment, an energy source, such as a battery, supplies electrical power to the homing system via a power conditioner, providing the means of activating the transducer elements of the homing array, thereby causing acoustical energy to be transmitted into the water according to a specified waveform. The acoustical energy is reflected from a target body, such as a submarine, back to the acoustical array, thereby stimulating a return electrical signal in each element of the transducer array. The return electrical signal is directed to an analog or digital beam-former, that is, an electrical device that processes the return electrical signal according to a particular algorithm in such a fashion as to provide an estimate of the location of the target body with respect to the transducer array. The location estimate is directed in electronic form to a homing control logic component, which, in turn: (1) records events, such as detection events; (2) processes the return electrical signal to classify the target as a body of a certain type; (3) records an estimated track of the target with respect to the transducer array; (4) makes decisions concerning desired action to be taken by the torpedo; and, (5) generates electronic commands to a torpedo guidance system, thereby directing the desired motion of the torpedo relative to the target. Furthermore in the exemplary embodiment, the guidance system generates electronic signals as input to an autopilot component that controls the vehicle in such a fashion as to minimize the error between the actual track of the torpedo, as may be measured by an inertial measurement unit (not shown in FIG. 3), and the desired track of the torpedo with respect to the target.

As noted above, an exemplary embodiment of the cavitator may include a sonar system. The sonar system may process the electrical signals to and from the homing array. The sonar system may include an electrical powering, conditioning, and distribution system adapted to operate the transducers; a beam-forming signal processing device operative to determine the direction of a noise-producing or noise-reflecting external object located arbitrarily within the operating range of the sonar system in the ambient liquid or an echo from an object similarly located; and a homing control logic system detect, classify, locate, and track the external object.

As previously noted, the supercavitating body, in an exemplary embodiment, may include a guidance system to command the motion of the supercavitating body based on the output of the homing control logic system; and a control system comprising an inertial measurement unit, an autopilot, actuators, and control effectors such as fins or cavitator actuation and articulation.

Exemplary embodiments of the present invention may provide control via a vectored thrust system, which may be employed with or without fins to enhance control; fins oriented with a fixed sweep-back angle, or articulated and positioned in the sweep-back degree of freedom via a constant-torque or controllable fin erection system; fins of varying configurations; additional control via an articulated cavitator; alternative thrust generation and ventilation via a hydroreactive gas generator (which would necessitate the inclusion of a water inlet in the design, which may in turn result in some modification to the cavitator shape if the inlet is hosted by the cavitator); and various useful modifications of the shapes and relative locations of the cavitator, the afterbody, the ventilator and its outlet, the fins, and the thruster. Although one embodiment includes a cavitator profile that maintains laminar flow over its forward part, alternative embodiments may relax this requirement.

Figure 2:
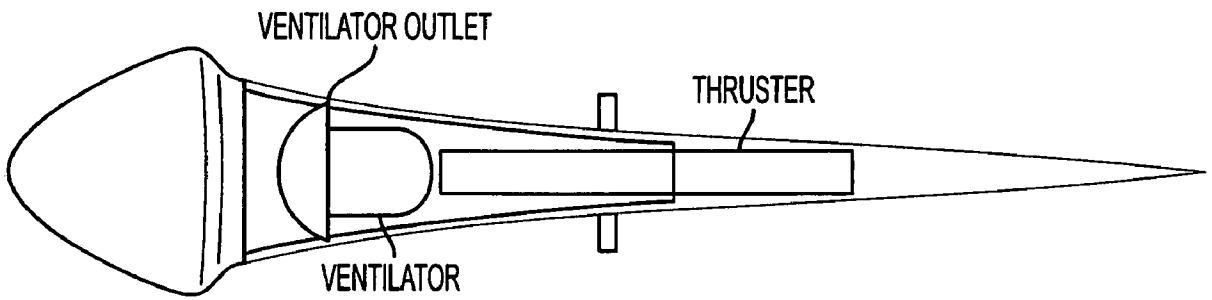
FIG. 2 depicts an internal view of the embodiment shown in FIG. 1.
Figure 4A:
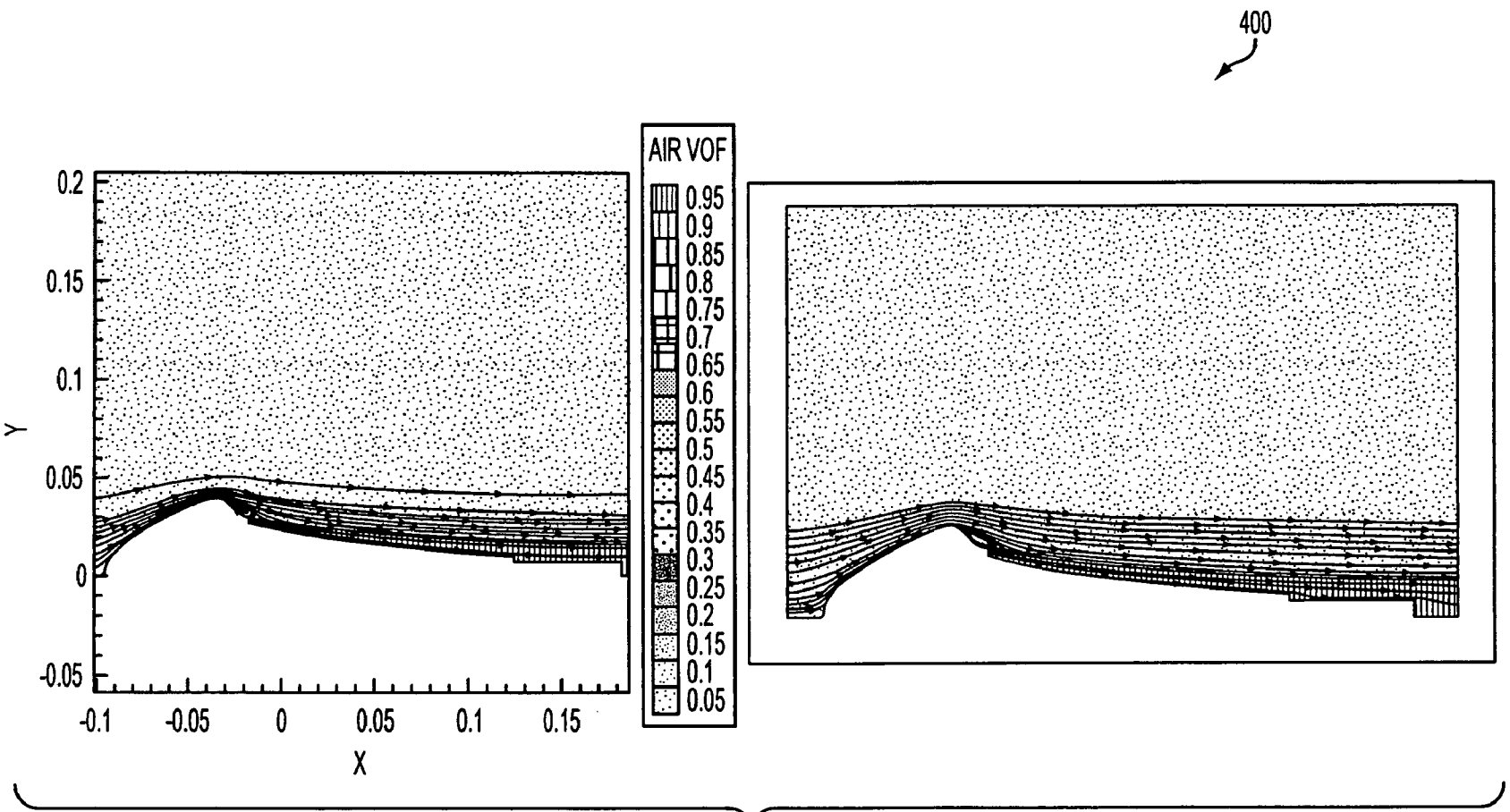
FIG. 4A depicts an exemplary chart depicting an exemplary predicted flow past an exemplary cavitator of the type depicted in the exemplary embodiment of FIG. 1 according to an exemplary embodiment of the present invention.
Figure 4B:
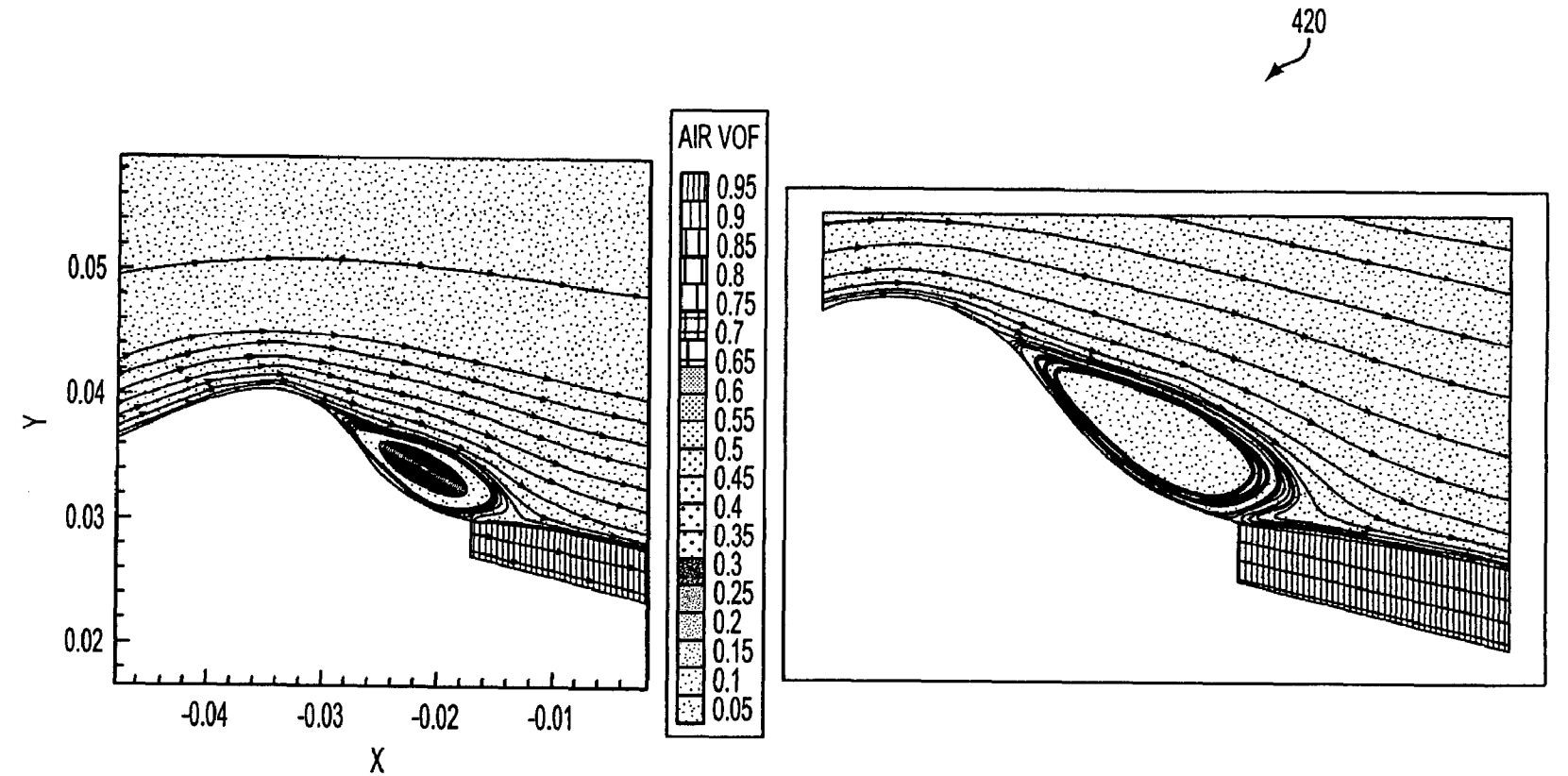
FIG. 4B depicts another exemplary chart depicting an exemplary predicted flow past the exemplary cavitator of FIG. 1 according to an exemplary embodiment of the present invention.

FIGS. 4A and 4B depict exemplary charts that exemplify predicted flow past an exemplary cavitator of the type depicted in FIG. 1, according to an exemplary embodiment of the present invention. The predicted flow was made with the aid of the commercially-available computational fluid dynamics model FLUENT. Specifically, FIG. 4A shows an exemplary embodiment of the flow domain from just upstream of the cavitator to the end of the body depicted in FIG. 1. Further, FIG. 4B depicts an exemplary close-up view of the flow in the region of the cavitator.

On each of FIGS. 4A and 4B, the x-axis is directed opposite to the direction of travel of the body, and the y-axis is the radial coordinate perpendicular to the x-axis. The flow field is modeled as an axisymmetric system extending from y=0 to a axisymmetric wall representing the wall of a notional water tunnel, such as one that may be used to test a physical model of such a device. In the body-fixed frame of reference, the flow of liquid enters the computational domain from the left side of the image and exits to the right. In the exemplary embodiment depicted in FIGS. 4A and 4B and modeled using FLUENT, the ventilation outlet is located at the step discontinuity at the after end of the cavitator (at an x-coordinate of approximately −0.0175 on the scale of this drawing).

The white region at y-coordinates greater than zero represents a cross section of the body composed of the cavitator, the afterbody, and the thruster. The fins claimed in various exemplary embodiments have not been modeled in these exemplary diagrams. Although the body of the thruster is modeled, this particular example has not modeled the flow of propulsion gas such as rocket ejecta that would be used to propel such a body.

Outside the profile of the body, the image has been color coded to represent the concentration of gas in the resulting flow predicted as a solution to the boundary value problem modeled with FLUENT, with red representing a concentration of 100% air and blue representing a concentration of 0% air (that is, pure water). The streamlines everywhere tangent to the instantaneous fluid velocity vector in the body-fixed reference frame are depicted as black lines with arrows indicating the direction of flow. The model applies the time-dependent algorithm known as "volume-of-fluid" in the art.

The exemplary image presented in FIGS. 4A and 4B was generated at a simulated time after the body had traveled several hundred cavitator diameters from its simulated starting point. It can be seen that the cavity separates cleanly and in a stable fashion from the detachment point at the after end of the cavitator, just outboard of the ventilation outlet. This result is provided as exemplary evidence of the claim of a cavitator designed to generate a stable, concave, cusped cavity of the type required to maintain low drag while allowing for an increased array aperture. Note the separated flow region that appears in way of the concave part of the cavitator, which causes a slight (albeit stable) bulge in the cavity just downstream of the ventilation outlet.

The exemplary operational conditions modeled in this simulation are those typical of conditions in a notional water tunnel that could be used to test such a device: water and air temperature and nominal pressure at standard laboratory conditions of approximately 15 C. and 100,000 Pa, respectively; fresh water at a density of 1000 kg/m^3; ventilation air at a nominal density of 1.21 kg/m^3; an operating depth of 1.5 m; gravitational acceleration of 9.81 m/s^2. In an exemplary embodiment, the cavitator radius at its downstream end (in way of the ventilation outlet) is 0.03 m.

The inflow velocity of the ambient water is 100 m/s, a value difficult to achieve in a water tunnel, but quite achievable in the free field, such as, e.g., but not limited to, a lake or an ocean, etc., for a rocket-propelled device of this size. The nominal gas exit velocity at the ventilation outlet is approximately 99.50 m/s, and directed tangent to the afterbody at the outlet. The above conditions may produce a cavitation number of −0.01, a negative value consistent with the concave shape of the cavity. This corresponds to a nominal cavity pressure of approximately 165,000 Pa and an outlet gas pressure of approximately 1.99 kg/m^3. The above noted exemplary specified conditions are exemplary and not limiting; the claims of this invention anticipate a range of operating conditions, body sizes and shapes, ventilation gas compositions, et cetera.

While various embodiments of the present invention have been described above, it should be understood that they have been presented by way of example only, and not limitation.

Thus, the breadth and scope of the present invention should not be limited by any of the above-described exemplary embodiments, but should instead be defined only in accordance with the following claims and their equivalents.

What is claimed is:

1. A supercavitating body comprising:

a cavitator assembly having a front end and a back end, and having a shape operative to generate a concave cavity;

an acoustical homing array coupled to said cavitator assembly;

an afterbody coupled to said back end;

a thruster coupled to said afterbody; and a ventilation system disposed within said afterbody, operative to supply gas to and to maintain pressure within the cavity.

2. The supercavitating body of claim 1, further comprising a fin coupled to said afterbody.

3. The supercavitating body of claim 1, further comprising:

a vectored thrust system, operative to enhance control.

4. The supercavitating body of claim 2, wherein said fin is oriented with a fixed sweep-back angle.

5. The supercavitating body of claim 2, further comprising a controllable fin erection system, operative to articulate and position said fin in the sweep-back degree of freedom.

6. The supercavitating body of claim 1, further comprising an articulated cavitator.

7. The supercavitating body of claim 1, wherein at least one of said thruster or said ventilation system comprise one or more hydroreactive gas generators, and further comprising a water inlet.

8. The supercavitating body of claim 1, wherein a profile of said cavitator maintains laminar flow over said front end.

9. The supercavitating body of claim 1, wherein said ventilation system comprises a ventilator disposed within said afterbody, and a ventilator outlet disposed on said afterbody.

10. The supercavitating body of claim 1, wherein said cavitator is operative to improve performance of a homing system, comprising sonar equipment.

11. The supercavitating body of claim 1, wherein said homing array comprises one or more transducers operative to transmit to and receive acoustical signals from the ambient liquid surrounding said body.

12. The supercavitating body of claim 11, further comprising a sonar system, operative to process the electrical signals to and from said homing array, the sonar system comprising:

an electrical powering, conditioning, and distribution system adapted to operate the transducers;

a beam-forming signal processing device operative to determine the direction of a noise producing external object located arbitrarily within the operating range of the sonar system in the ambient liquid or an echo from an object similarly located; and a homing control logic system operative to detect, classify, locate, and track the external object.

13. The supercavitating body of claim 12, further comprising:

a guidance system operative to command the motion of said supercavitating body based on the output of the homing control logic system; and a control system comprising an inertial measurement unit, an autopilot, actuators, and control effectors.

14. The supercavitating body of claim 1, wherein said homing array is disposed within said cavitator assembly.

15. The supercavitating body of claim 1, wherein said homing array is disposed on the external surface of said cavitator assembly.

16. The supercavitating body of claim 1, wherein said cavitator assembly has a profile that is convex at said front end in a direction of travel and concave at said back end; and wherein said cavitator assembly forms a stable hydrodynamic cavitation region within which the cavity pressure of gas in the cavity is greater than the ambient hydrostatic pressure far upstream of and at the same depth as the cavitator assembly.

* * * * *